US008333481B2

(12) United States Patent
Deng

(10) Patent No.: US 8,333,481 B2
(45) Date of Patent: Dec. 18, 2012

(54) LED EMERGENCY LIGHT

(76) Inventor: Jia H. Deng, Diamond Bar, CA (US)

( * ) Notice: Subject to any disclaimer, the term of this patent is extended or adjusted under 35 U.S.C. 154(b) by 292 days.

(21) Appl. No.: 12/327,866

(22) Filed: Dec. 4, 2008

(65) Prior Publication Data

US 2009/0146573 A1 Jun. 11, 2009

Related U.S. Application Data

(60) Provisional application No. 61/005,473, filed on Dec. 4, 2007.

(51) Int. Cl.
*F21V 19/04* (2006.01)

(52) U.S. Cl. ..... 362/20; 362/276; 362/802; 362/650; 315/86

(58) Field of Classification Search ..... 362/20, 362/183, 184, 276, 802, 236, 650; 315/86, 315/196, 175
See application file for complete search history.

(56) References Cited

U.S. PATENT DOCUMENTS

| | | | | |
|---|---|---|---|---|
| 5,700,154 | A * | 12/1997 | Geary | 439/236 |
| 5,734,229 | A * | 3/1998 | Bavaro et al. | 315/86 |
| 6,107,744 | A * | 8/2000 | Bavaro et al. | 315/86 |
| 6,285,132 | B1 * | 9/2001 | Conley et al. | 315/86 |
| 6,965,205 | B2 * | 11/2005 | Piepgras et al. | 315/318 |
| 7,429,118 | B1 * | 9/2008 | Borowiak | 362/194 |
| 7,665,882 | B1 * | 2/2010 | Wang | 362/650 |
| 7,690,802 | B2 * | 4/2010 | Higley et al. | 362/20 |
| 7,703,934 | B2 * | 4/2010 | Pape et al. | 362/20 |
| 7,857,480 | B2 * | 12/2010 | Steele et al. | 362/197 |
| 2005/0157482 | A1 * | 7/2005 | Hsu | 362/20 |
| 2006/0238136 | A1 * | 10/2006 | Johnson, III et al. | 315/185 R |

* cited by examiner

*Primary Examiner* — John A Ward
(74) *Attorney, Agent, or Firm* — FSP LLC

(57) ABSTRACT

A lighting apparatus includes a primary lighting source powered by from a facility A-C power source, and backup LED lighting source powered by batteries.

13 Claims, 2 Drawing Sheets

LED EMERGENCY LIGHT

TECHNICAL FIELD

The present disclosure relates to lighting systems.

BACKGROUND

During loss of electrical power, backup power systems may engage to provide people with enough light to evacuate or continued activity until normal power is restored. Backup power systems should provide adequate lighting for a sufficient time period to facilitate these purposes.

BRIEF DESCRIPTION OF THE DRAWINGS

In the drawings, the same reference numbers and acronyms identify elements or acts with the same or similar functionality for ease of understanding and convenience. To easily identify the discussion of any particular element or act, the most significant digit or digits in a reference number refer to the figure number in which that element is first introduced.

DETAILED DESCRIPTION

References to "one embodiment" or "an embodiment" do not necessarily refer to the same embodiment, although they may.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list.

"Logic" refers to signals and/or information that may be applied to influence the operation of a device. Software, hardware, and firmware are examples of logic. Hardware logic may be embodied in circuits. In general, logic may comprise combinations of software, hardware, and/or firmware.

Those skilled in the art will appreciate that logic may be distributed throughout one or more devices, and/or may be comprised of combinations of instructions in memory, processing capability, circuits, and so on. Therefore, in the interest of clarity and correctness logic may not always be distinctly illustrated in drawings of devices and systems, although it is inherently present therein.

Figure 1:
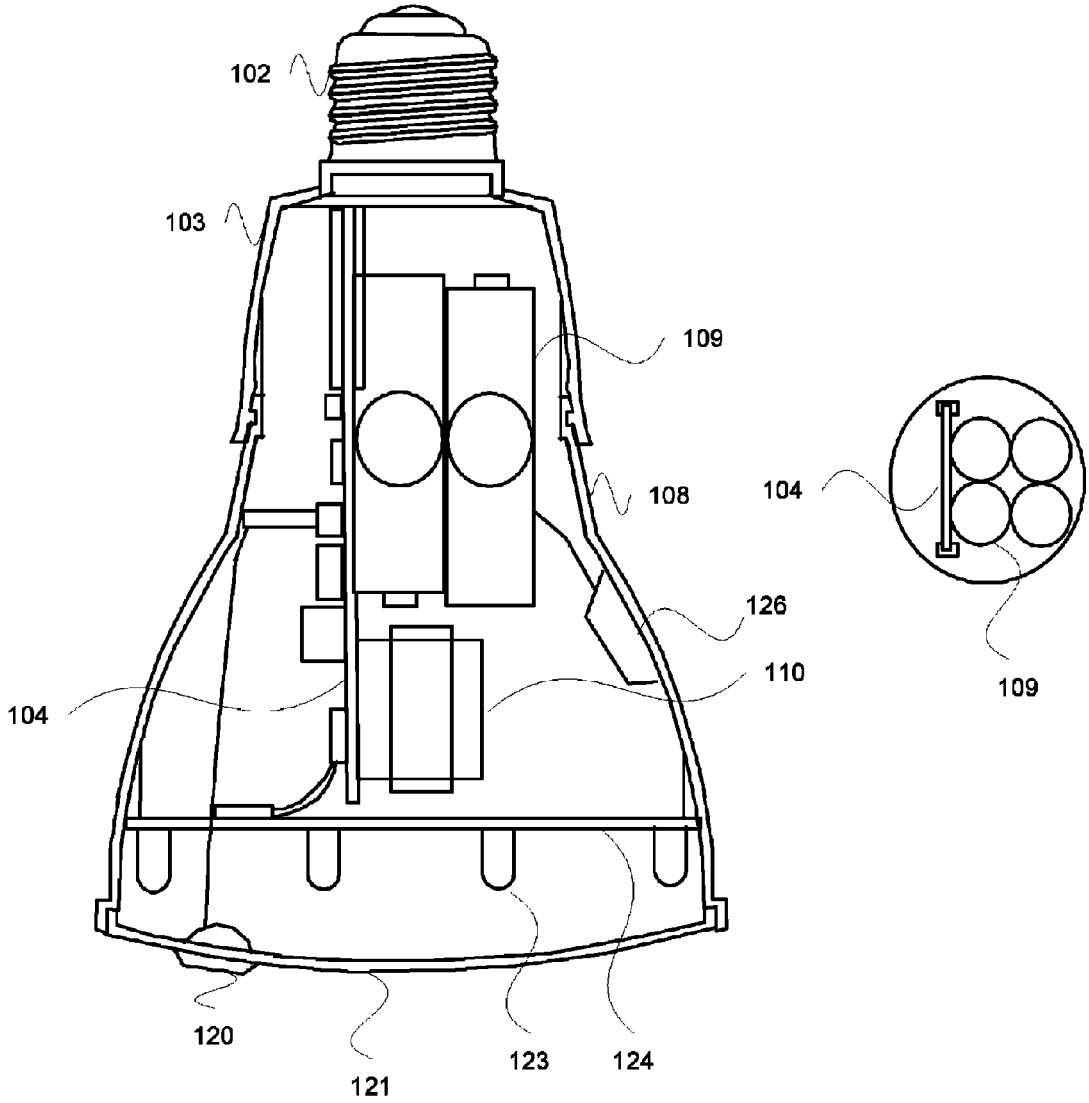
FIG. 1 is an illustration of an embodiment of a backup lighting apparatus employing LEDs.

FIG. 1 is an illustration of an embodiment of a backup lighting apparatus employing LEDs. The apparatus includes, but may not be limited to, an electrical interface 102, an upper housing unit 103, an LED PCB 104, power outage LEDs 123, batteries 109, test control 120, a lower face plate 121, a primary lighting element 110, and a lower housing unit 108. Other elements and/or couplings among the elements have been omitted as they would be apparent to skilled practitioners in the relevant art(s).

The electrical interface 102 is an interface to source of electrical power, such as, for example, an E26/27 electrical coupling as found on A19 type incandescent bulbs or R20/30/40 halogen/incandescent. The upper housing unit 103 is coupled to electrical interface 102, and retains lower housing unit 108, which may be disengaged from upper housing unit 103 in order to service the emergency light. This may be necessary, for example, to replace batteries 109. The upper housing may be formed, for example, from molded plastic, aluminum, steel, or porcelain.

The lower housing unit 108 is coupled to upper housing unit 103, and may be disengaged from upper housing unit 103 in order to service the emergency light, for example to replace batteries or to service-replace primary lighting element 110. The lower housing may be formed from, for example, one or more molded plastic, aluminum, steel, or porcelain.

The LED PCB 104 comprises driver and control logic for power outage LEDs 123 configured on a mounting plate 124. The PCB (printed circuit board) 104 may comprise one or more devices to derive power from the electrical interface 102 during normal power conditions, and from batteries 109 during outages of normal electrical power. Power from either source may be appropriately conditioned and provided to the LED's 123 and/or the primary lighting source 110, as appropriate to the conditions. The power outage LEDs 123 activate upon loss of standard electrical power to electrical interface 102, for example during a primary A/C power failure. The LEDs 123 may comprise one or more lower-power consumption LEDs.

The batteries 109 provide power to LED PCB 104 which in turns powers and controls power outage LEDs 123 during outages of normal electrical power, i.e. when electrical interface 102 is no longer able to provide electrical power. The batteries 109 may comprise, for example, one or more disposable batteries, for example alkaline or lithium-thionyl chloride; or they may be rechargeable batteries, for example nickel cadmium or nickel metal hydride. In the case of rechargables, recharging current/voltage may be provided via the electrical interface 102 after the batteries 109 are depleted after a power outage.

A test control 120 is coupled to LED PCB 104 and is useful for service tests to comply with regulatory requirements on periodic testing of emergency service equipment. The control 120 may be mounted to lower face plate 121 for easy access by service personnel. Activating the control 120 may simulate loss of power to electrical interface 102, resulting in deactivation of primary lighting element 110 and activation of power outage LEDs 123. The control 120 may be implemented, for example, as one or more button, switch, touch pad, or photosensor.

A lower face plate 121 is a coupled to lower housing unit 108, and may be disengaged from lower housing unit 108 in order to service the power outage. LEDs 123. The face plate 121 may be implemented, for example, as one or more plastic elements (acrylic, polycarbonate, etc.), glass, etc. may possibly not be present at all in some applications.

The primary lighting element 110 provides light during normal operation, when electrical power is available from electrical interface 102. The primary lighting 110 may be implemented, for example, using one or more high intensity high-power LED(s) (for LEDs rated for current draws of 300 mA or more), incandescent lighting element(s), a fluorescent lighting element (in which case LED PCB 104 may comprise a fluorescent driver circuit and/or ballast element).

Other examples and/or embodiments of an electrical interface 102, upper housing unit 103, LED PCB 104, power outage LEDs 123, batteries 109, test control 120, lower face plate 121, primary lighting element 110, and lower housing unit 108 may be apparent to skilled practitioners in the relevant art(s).

Some embodiments may further comprise a smoke sensor and/or $CO_2$ sensor 126. The lower housing 108 may be grilled to allow sound from the alarm to escape. The sensor 126 may draw power from the interface 102 or the PCB 104. In some embodiments, the sensor 126 may, upon detecting an alarm condition, signal the PCB 104 to flash or otherwise signal the condition via the primary 110 or backup 123 lighting elements.

Figure 2:
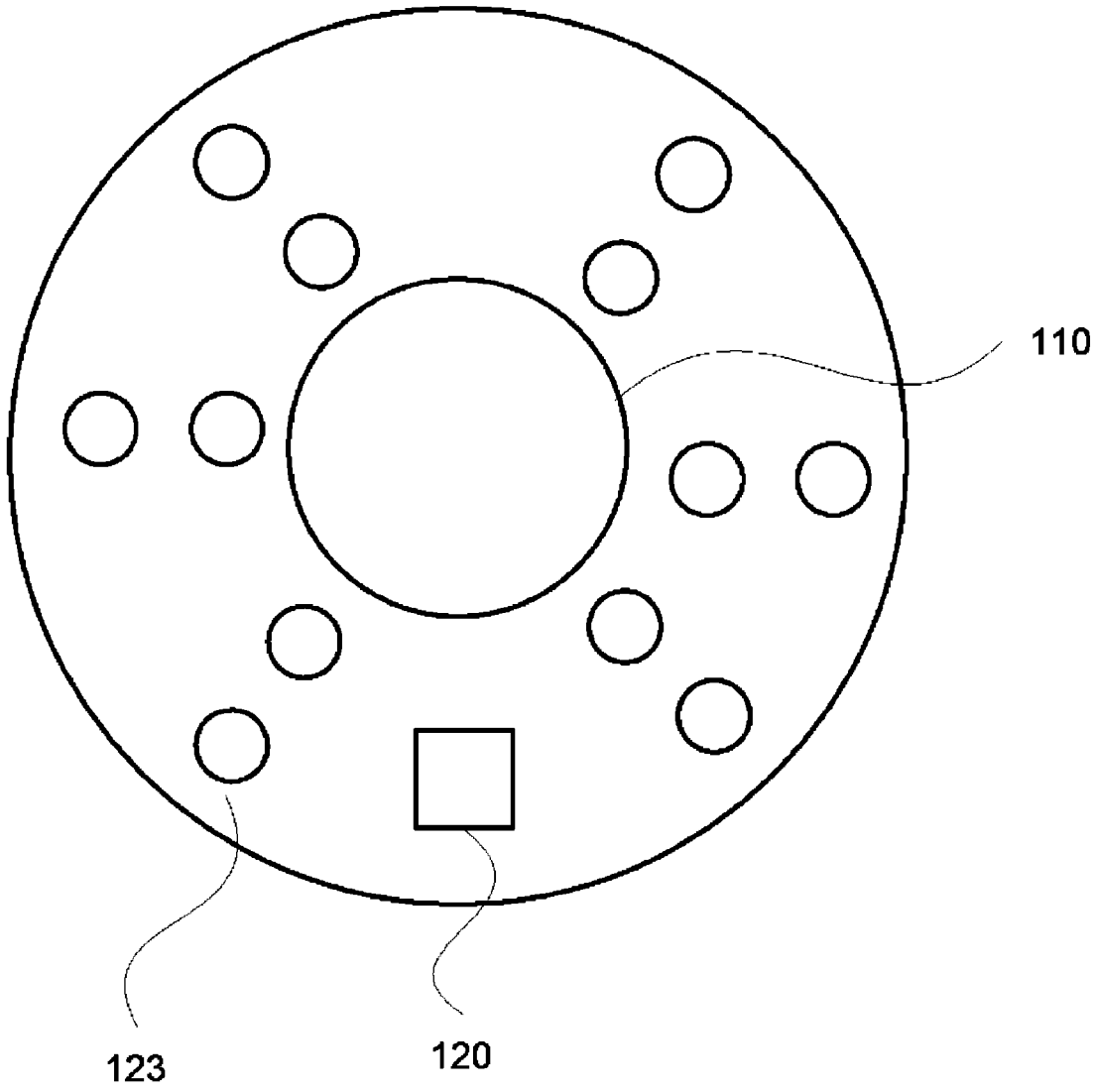
FIG. 2 is an illustration of lighting elements of an embodiment of a backup lighting apparatus employing LEDs.

FIG. 2 is an illustration of lighting elements of an embodiment of a backup lighting apparatus employing LEDs. The perspective is up through the face plate 121. This illustration provides merely one example of the various and numerous ways in which the backup 123 and primary lighting elements 110 may be arranged.

Those having skill in the art will appreciate that there are various vehicles by which processes and/or systems described herein can be effected (e.g., hardware, software, and/or firmware), and that the preferred vehicle will vary with the context in which the processes are deployed. For example, if an implementer determines that speed and accuracy are paramount, the implementer may opt for a hardware and/or firmware vehicle; alternatively, if flexibility is paramount, the implementer may opt for a solely software implementation; or, yet again alternatively, the implementer may opt for some combination of hardware, software, and/or firmware. Hence, there are several possible vehicles by which the processes described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations may involve optically-oriented hardware, software, and or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood as notorious by those within the art that each function and/or operation within such block diagrams, flowcharts, or examples can be implemented, individually and/or collectively, by a wide range of hardware, software, firmware, or virtually any combination thereof. Several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in standard integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and/or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies equally regardless of the particular type of signal bearing media used to actually carry out the distribution. Examples of a signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment).

Those skilled in the art will recognize that it is common within the art to describe devices and/or processes in the fashion set forth herein, and thereafter use standard engineering practices to integrate such described devices and/or processes into larger systems. That is, at least a portion of the devices and/or processes described herein can be integrated into a network processing system via a reasonable amount of experimentation.

The foregoing described aspects depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

What is claimed is:

1. A lighting apparatus comprising:

a male threaded E26/27 A/C electrical coupling;

an upper housing comprising the male threaded E26/27 A/C electrical coupling at a first end and a retainer for a lower housing on a second end opposite the first end;

the lower housing detachable from the upper housing;

a battery power source positioned to be exposed upon detaching the lower housing from the upper housing;

a detachable faceplate, coupled to the upper housing;

a primary lighting source configured to draw power from the A/C electrical coupling; and a backup LED lighting source configured to draw power from the battery and configured to turn on when A/C power is removed from the male threaded E26/27 A/C electrical coupling.

2. The lighting apparatus of claim 1, wherein the primary lighting source comprises one or more high-intensity LED.

3. The lighting apparatus of claim 1, wherein the primary lighting source comprises an incandescent lighting source.

4. The lighting apparatus of claim 1, wherein the primary lighting source comprises a fluorescent lighting source.

5. The lighting apparatus of claim 1, wherein the backup LED lighting source further comprises:

LEDs having a lower intensity and power requirements than the primary lighting source.

6. The lighting apparatus of claim 1, further comprising:

a control positioned to be accessible to test personnel while the apparatus is coupled to the facility A-C power source, activation of the control simulating primary power outage conditions within the apparatus.

7. The lighting apparatus of claim 6, further comprising:

the control is one or more button, switch, touch pad, or photosensor mounted on the faceplate.

8. The lighting apparatus of claim 6, further comprising:

the lower housing configured to expose a socket for the primary lighting source and the battery power source upon being detached from the upper housing.

9. The lighting apparatus of claim 6, further comprising:

a socket for the primary lighting source positioned behind a mounting plate for the secondary lighting source, the mounting plate configured with an opening to pass the primary lighting source through to the socket.

10. The lighting apparatus of claim 1, further comprising:

the battery power source extending across a detachment boundary between the upper and lower housings.

11. The lighting apparatus of claim 1, further comprising:

the lower housing comprises a sound-permeable grill.

12. The lighting apparatus of claim 1, further comprising:

the primary lighting source centrally located in relation to the backup lighting source.

13. The lighting apparatus of claim 1 further comprising:

the primary lighting source is an incandescent bulb and the backup lighting source is LEDs having a current draw lower than 300 mA, surrounding the incandescent bulb.

* * * * *